US005329637A

United States Patent [19]

Walker

[11] Patent Number: 5,329,637

[45] Date of Patent: Jul. 19, 1994

[54] FIREMAN'S HELMET WITH INTEGRAL FRONT AND REAR LIGHTS

[76] Inventor: Joseph W. Walker, 504 Briggs St., Wilson, N.C. 27893

[21] Appl. No.: 944,662

[22] Filed: Sep. 14, 1992

[51] Int. Cl.[5] ..... A42B 3/30

[52] U.S. Cl. ..... 2/5; 2/906; 340/573; 362/106; 455/100

[58] Field of Search ..... 2/5, 209.1, 209.2, 209.3, 2/410, 6.1, 6.6, 906; 362/106; 340/321, 331, 539, 573; 379/37, 38, 51; 455/100, 89

[56] References Cited

U.S. PATENT DOCUMENTS 3,302,018 1/1967 Harding ..... 362/106
4,945,458 7/1990 Batts ..... 2/5
5,006,832 4/1991 Beaudry ..... 340/573
5,044,016 9/1991 Coombs ..... 2/5
5,200,736 4/1993 Coombs et al. ..... 2/5

FOREIGN PATENT DOCUMENTS 285938 10/1988 European Pat. Off. ..... 2/410

OTHER PUBLICATIONS

*RESCU* advertisement of Aug. 1979.

*Primary Examiner*—Clifford D. Crowder
*Assistant Examiner*—Diana L. Biefeld

[57] ABSTRACT

The present invention relates to an improved fireman's helmet which includes a surrounding wall structure that defines a head receiving area therein. Mounted within the head receiving area and recessed in the wall structure are front and rear light assemblies as well as a battery pack and control panel.

6 Claims, 8 Drawing Sheets

FIREMAN'S HELMET WITH INTEGRAL FRONT AND REAR LIGHTS

REFERENCE TO RELATED APPLICATION

This application is an improvement over application No. 314,163, filed on Feb. 23, 1989, now U.S. Pat. No. 4,945,458 which is a continuation-in-part of serial No. 156,410, filed on Feb. 16, 1988, now abandoned.

FIELD OF THE INVENTION

The present invention relates to a fireman's helmet provided with integrally formed front and rear light assemblies. The improved helmet is much safer and compact than the helmet disclosed in the above-mentioned patent.

SUMMARY OF THE INVENTION

One object of the present invention is to provide a fireman's helmet with front and rear light assemblies which can easily be controlled by the fireman while wearing the helmet.

Another object of the present invention is to provide a helmet with light assemblies which may be controlled from a remote location.

Another object of the present invention is to provide a fireman's helmet with integral light assemblies which are built into the helmet and do not extend outwardly of the helmet in an obtrusive manner.

Another object is to provide a helmet in which all batteries and wiring used to power the light assemblies fit into recesses and grooves made integral with the helmet.

Another object is to provide a helmet that incorporates a signaling or communications system.

These and other objects of the present invention will become readily apparent upon further review of the following specifications and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
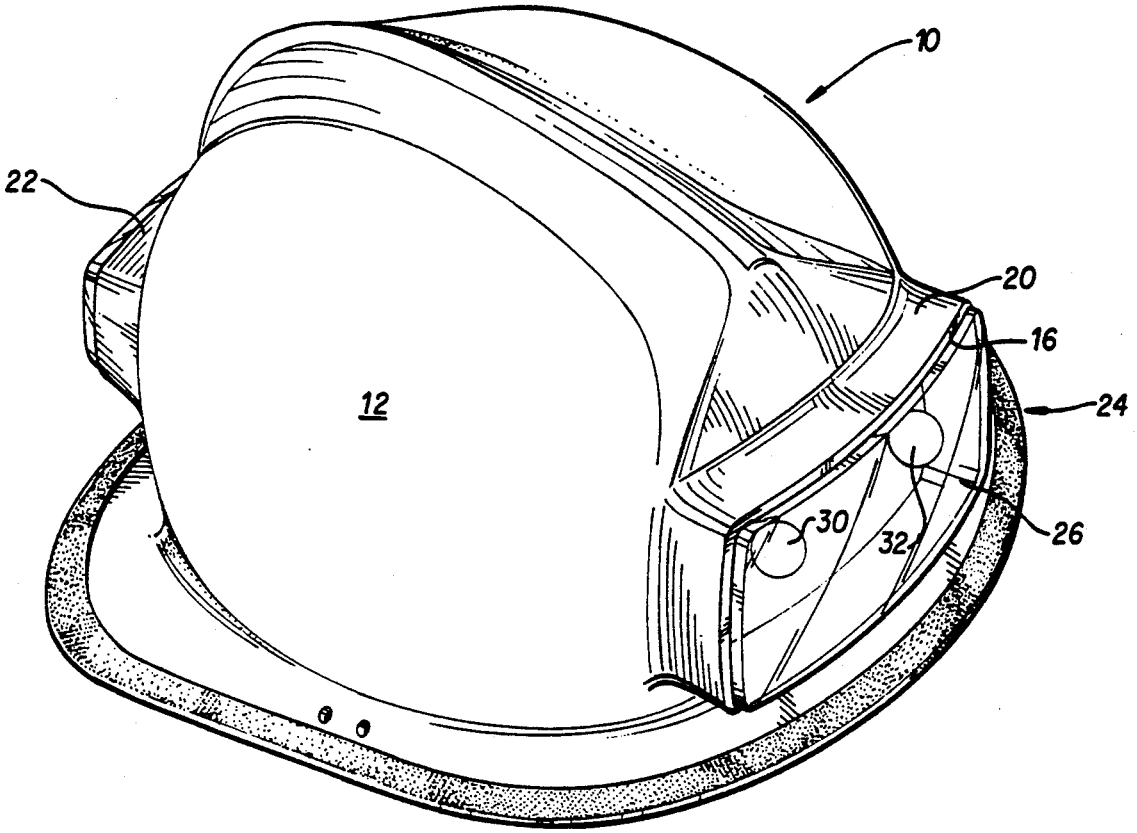
FIG. 1 is a perspective view of the fireman's helmet of the present invention.
Figure 2:
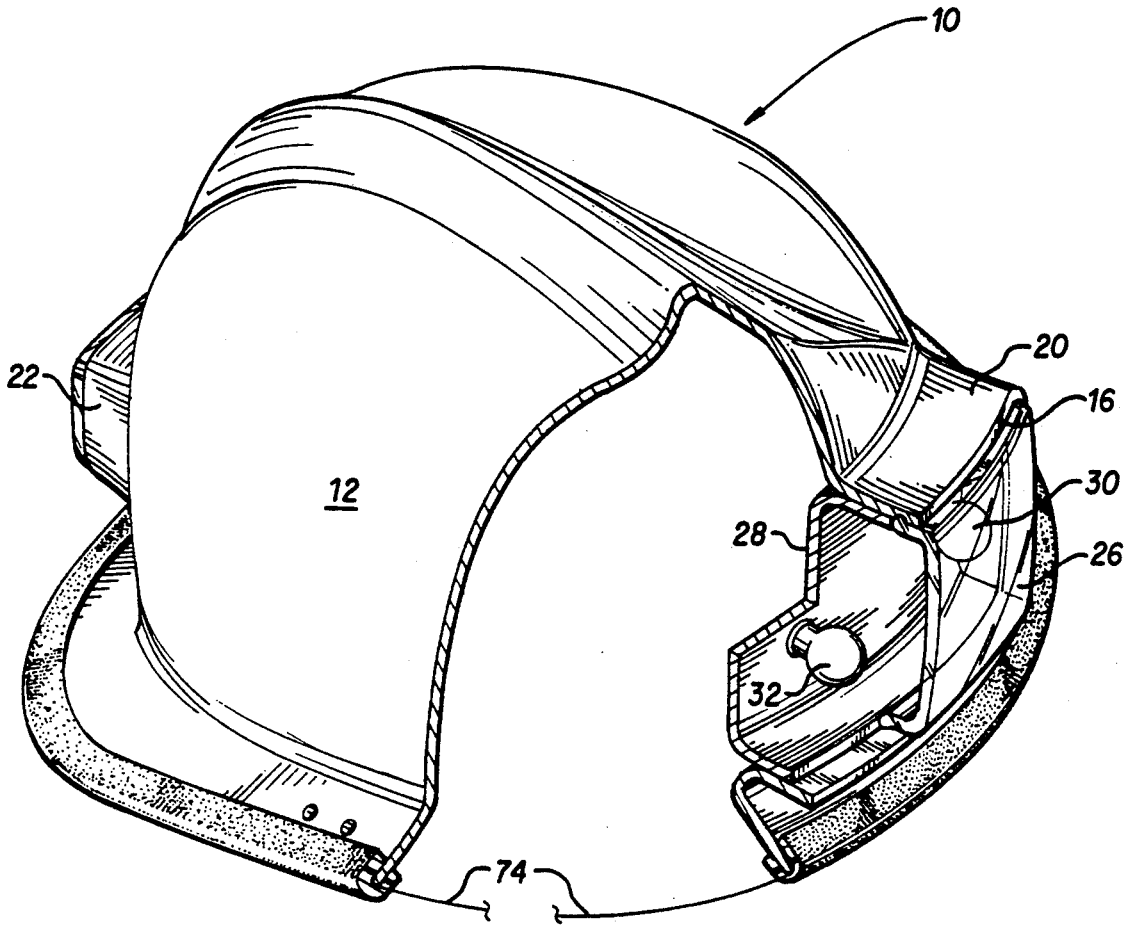
FIG. 2 is a perspective fragmentary view illustrating the integral construction of the helmet and front light assembly.
Figure 3:
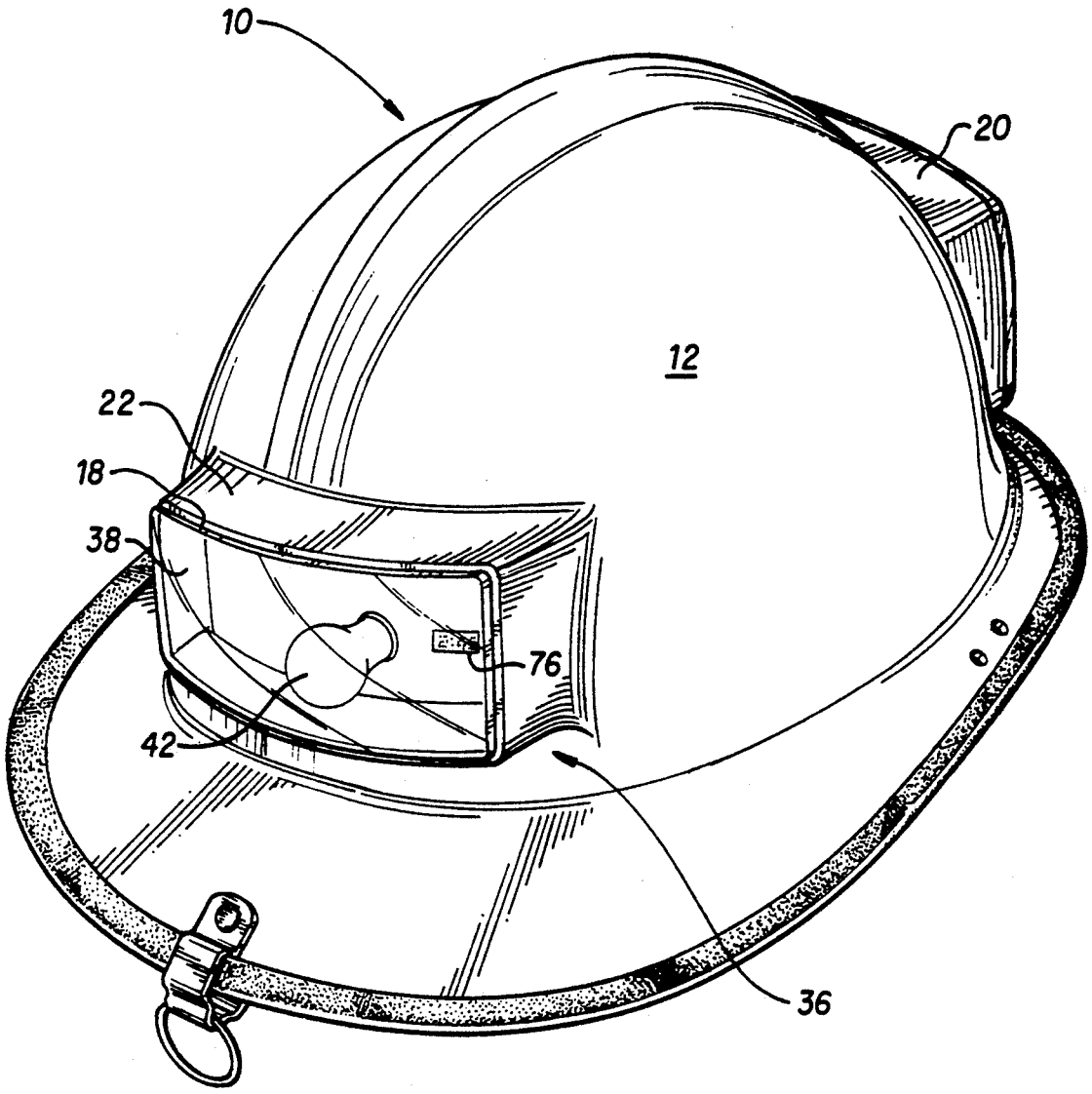
FIG. 3 is perspective view illustrating the rear light assembly.
Figure 4:
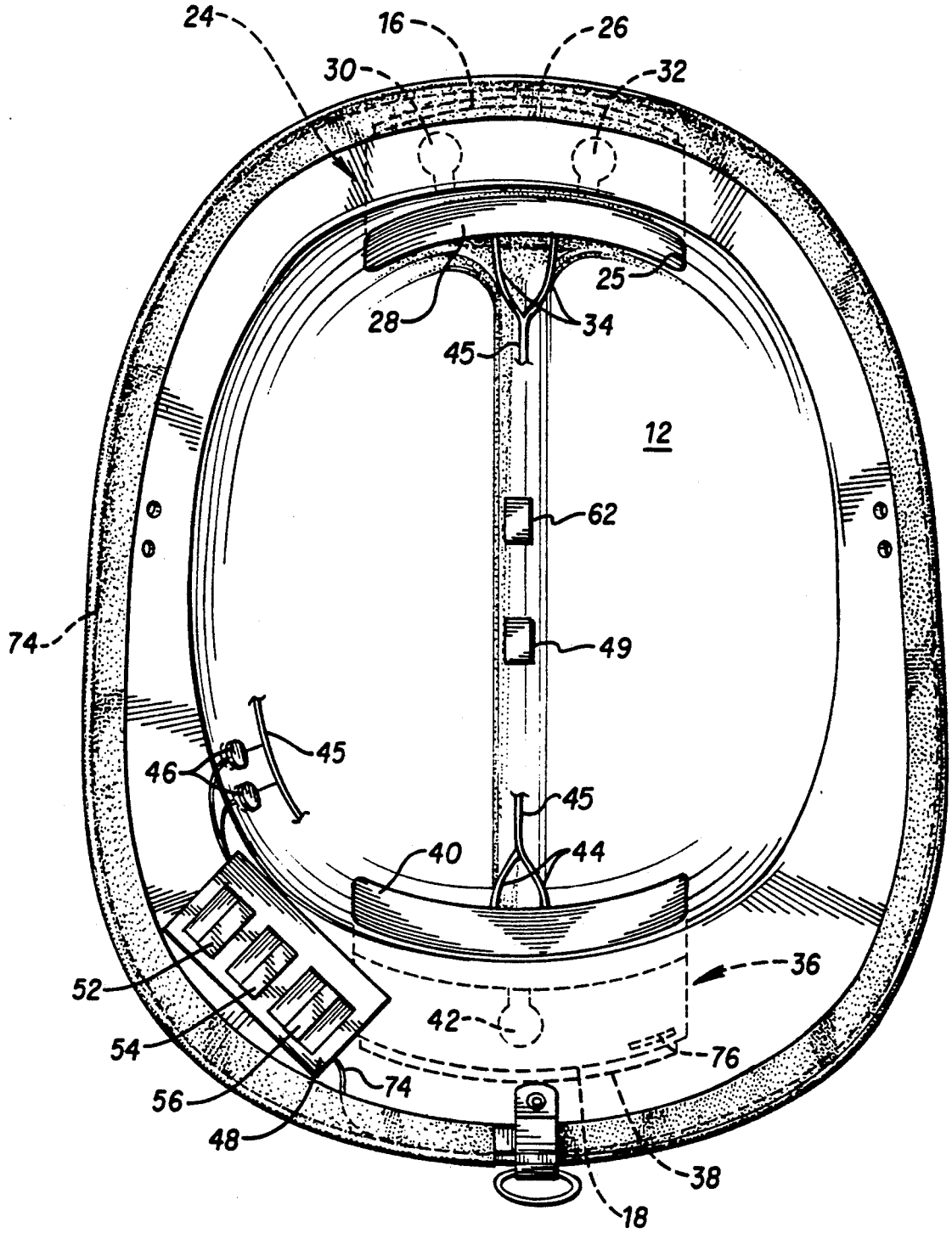
FIG. 4 is a bottom view of the helmet.

The present invention is a fireman's helmet generally designated in the drawings as numeral 10. It can be seen that the helmet includes a surrounding wall structure 12 that defines a head receiving area therein. Wall structure 12 has a front opening 16 and a rear opening 18. A front flange 20 extends outwardly around the circumference of front opening 16. A rear flange 22 extends outwardly around the circumference of rear opening 18.

A front light assembly 24 is integrally formed within wall structure 12 about the front area and opening 16. Light assembly 24 includes a lens 26 and a housing structure 28. Secured within housing 28 are double light bulbs 30 and 32. Note that housing 28 fits in a recess 25 in wall structure 12. Lens 26 is transparent and generally lies closely adjacent the surrounding wall structure 12. Connecting wires 34 connect to light bulbs 30 and 32 and extend from housing 28. The wires 34 fit into grooves 45 molded on the inside surface of wall structure 12.

A rear light assembly 36 is constructed about the rear portion of wall structure 12. The assembly 36 includes a red reflector type lens 38, housing 40 and bulb 42. A set of wires 44 are connected to bulb 42 and extend from assembly 36. Wires 44 also fit into molded grooves 45.

To power front light assembly 24 and rear light assembly 36 the helmet is provided with a battery pack 46 recessed into wall structure 12. Battery pack 46 includes two rechargeable lithium batteries. The battery pack 46 is wired so that when the voltage of one battery falls below a predetermined value, the second battery automatically takes over.

To control front and rear light assemblies 24 and 36 there is provided a switch panel 48 that is operatively interconnected between light assemblies 24 and 36 and the battery pack 46. In addition, there is provided a watch panel 48 and front light assembly 24. Switch panel 48 includes a series of switches 52,54,56 that control the front and rear light assemblies 24 and 36. As seen in the schematic, the front and rear light assemblies 24 and 36 can be actuated to assume the "on" position at the same time or they each can be operated independently. Switch 52 simply actuates front light assembly 24. Switch 54 actuates front light assembly 24. Switch 54 actuates front light 24 through the flasher 50. In order for the flasher to be effective, switch 52 must be in the "off" position. Switch 56 is a three position switch. In one position, switch 56 is operative to actuate front light 24. In a second position switch 56 actuates light 36. Finally switch 56 includes an "off" position.

It is desirable for a fire chief or some other individual associated with the fire department to have the capability of remotely actuating and controlling the front and rear light assemblies 24 and 36. Therefore, the present invention provides actuating and control transmitter 58 that is designed to actuate a receiver 60 which is operatively connected in the circuit shown in FIG. 5. Therefore, an individual stationed outside a burning structure can actuate the lights on a fireman's helmet who is inside a burning building. This obviously would aid in locating a fireman in trouble.

Figure 5:
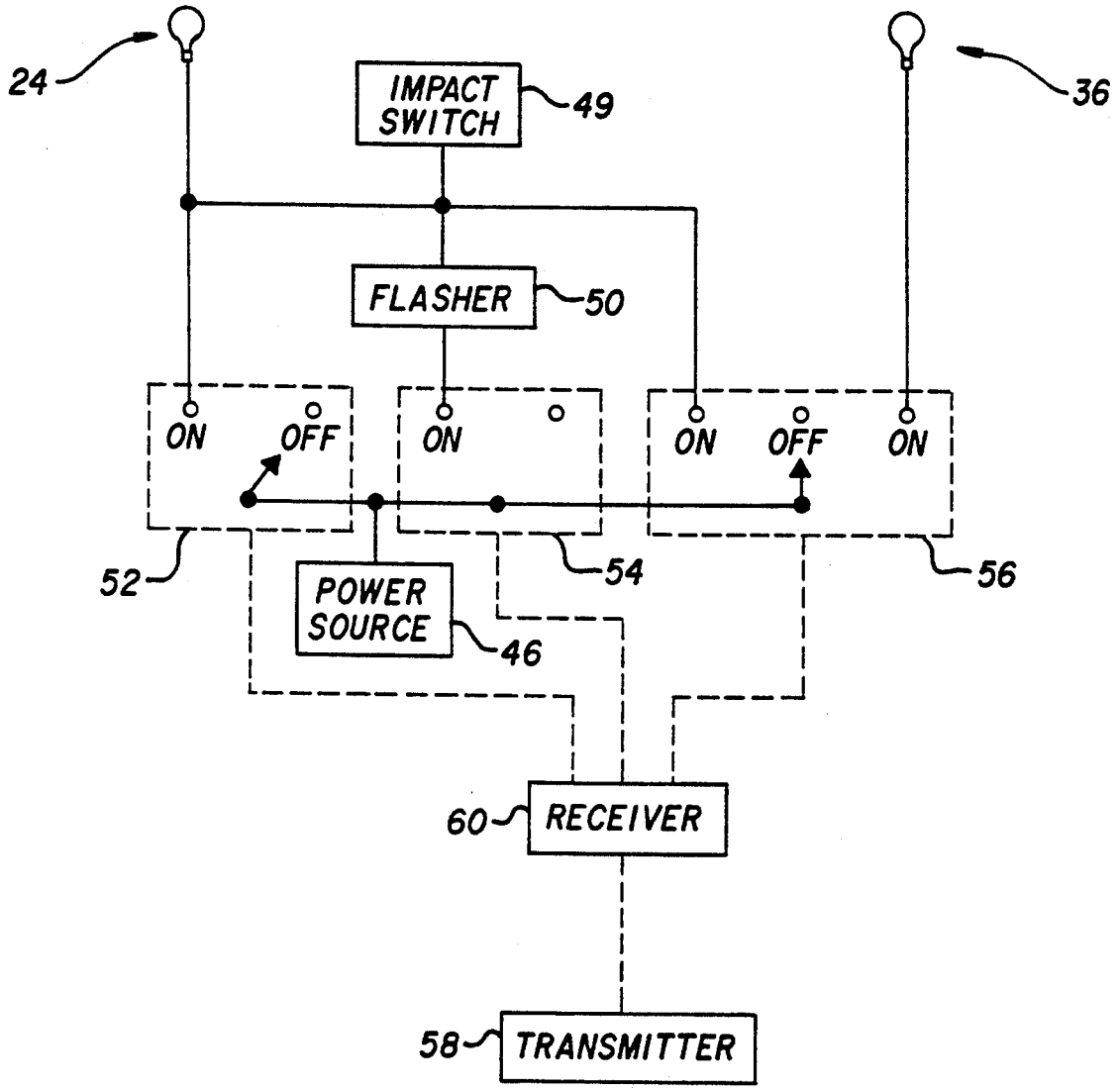
FIG. 5 is a schematic illustration of the switching control system for the front and rear light assemblies of the helmet.

As shown in FIG. 5, the flasher 50 gives the helmet communications capability, especially when considered with transmitter 58 and receiver 60. For example, if the fire chief sees that one or more fireman are in imminent danger, he can actuate flasher 50 causing light 24 to flash on a helmet being worn by firemen. It can be predetermined that this is a signal of danger and a command or advisory to fireman involved to move away from the point of imminent danger. A fireman wearing the helmet may actuate flasher 50 to signal the fire chief if he is in trouble. Thus, the fireman's helmet of the present invention incorporates communication and signaling capabilities.

Now turning to 6, a second embodiment for the helmet 10 is shown. This helmet is essentially the same as the previously discussed helmet; however, there are new design features or elements which are claimed.

Figure 6:
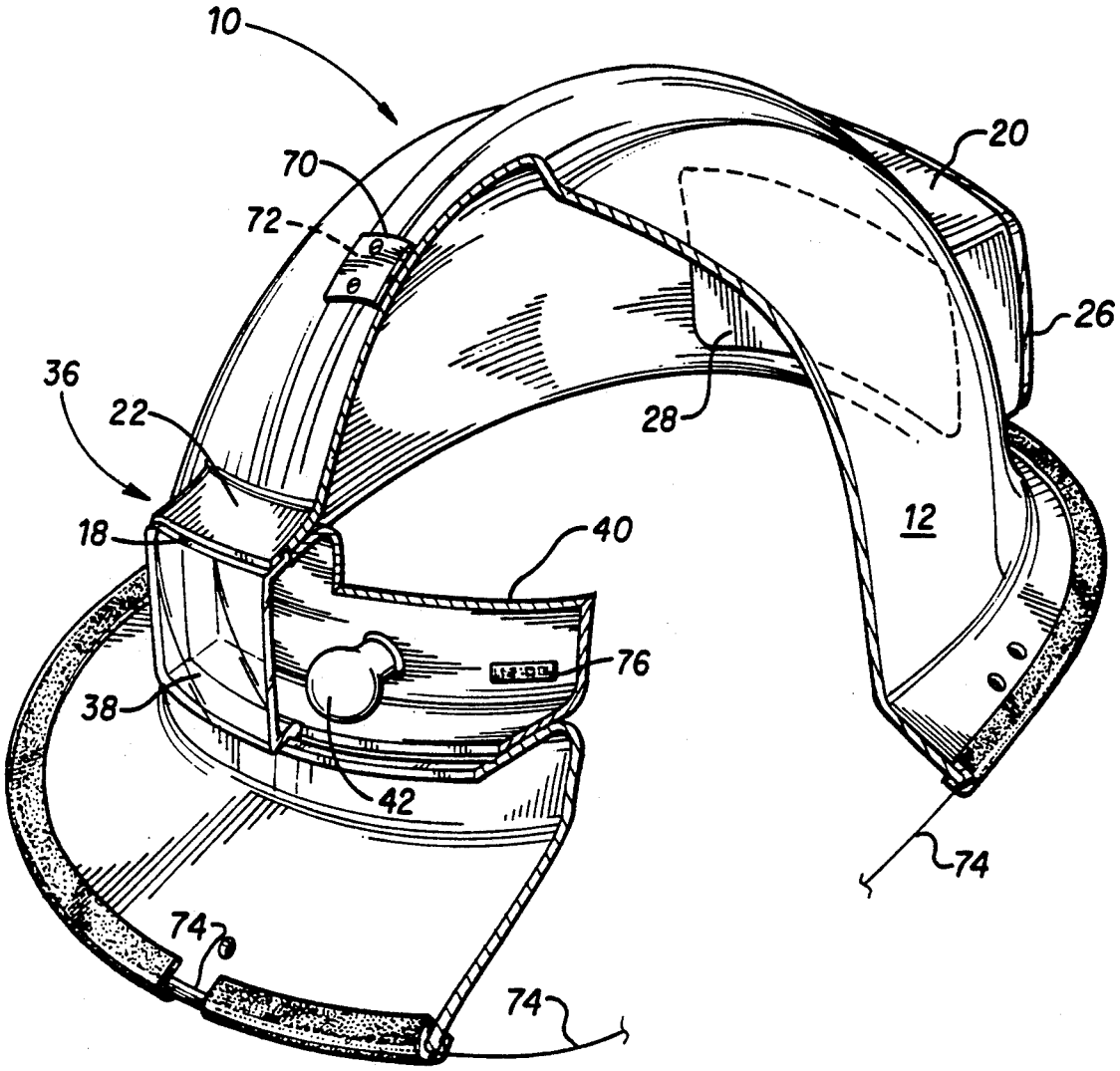
FIG. 6 is a perspective view of a second embodiment of the invention.

It can be seen that the second embodiment in FIG. 6 includes a battery compartment 70 recessed in wall structure 12. Access is gained to compartment 70 through panel 72 secured within an opening formed about the surface of the helmet 10. This allows the batteries to be easily changed.

Figure 8:
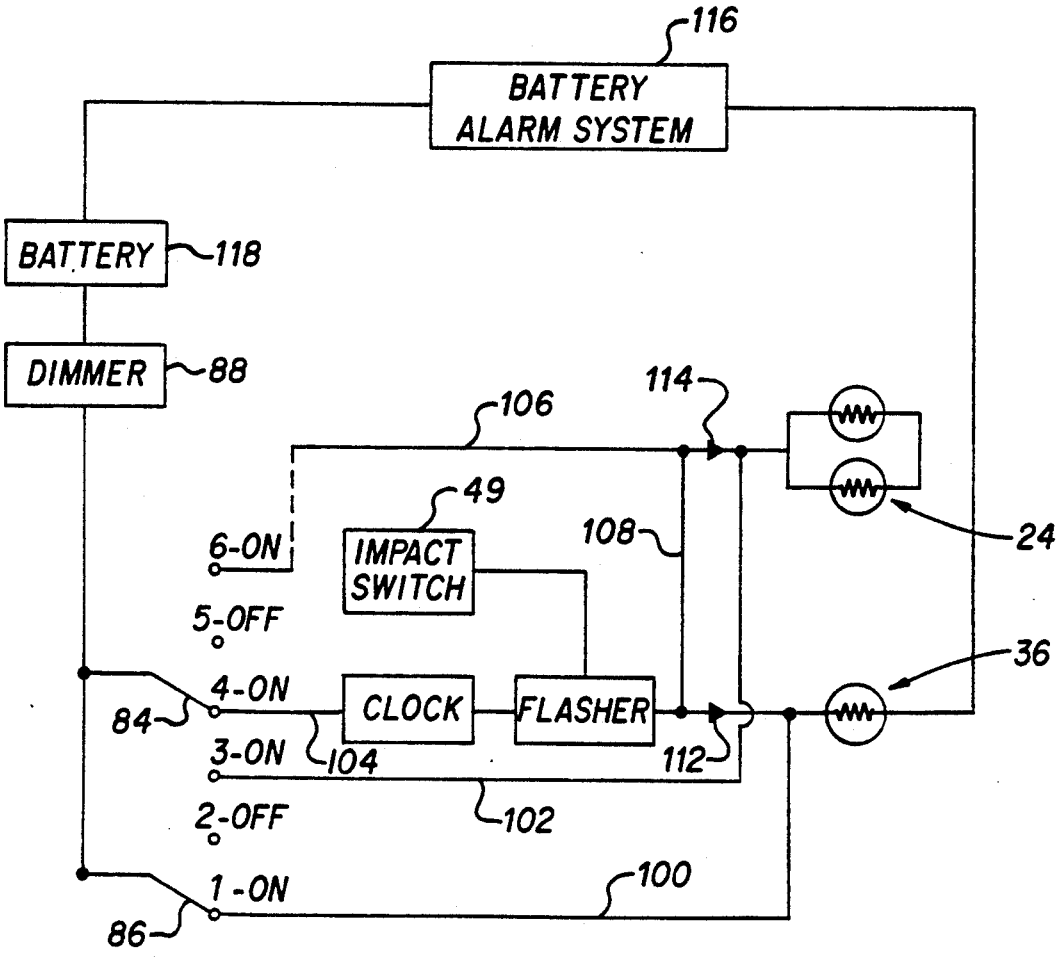
FIG. 8 is an electrical schematic for the second embodiment.
Figure 9:
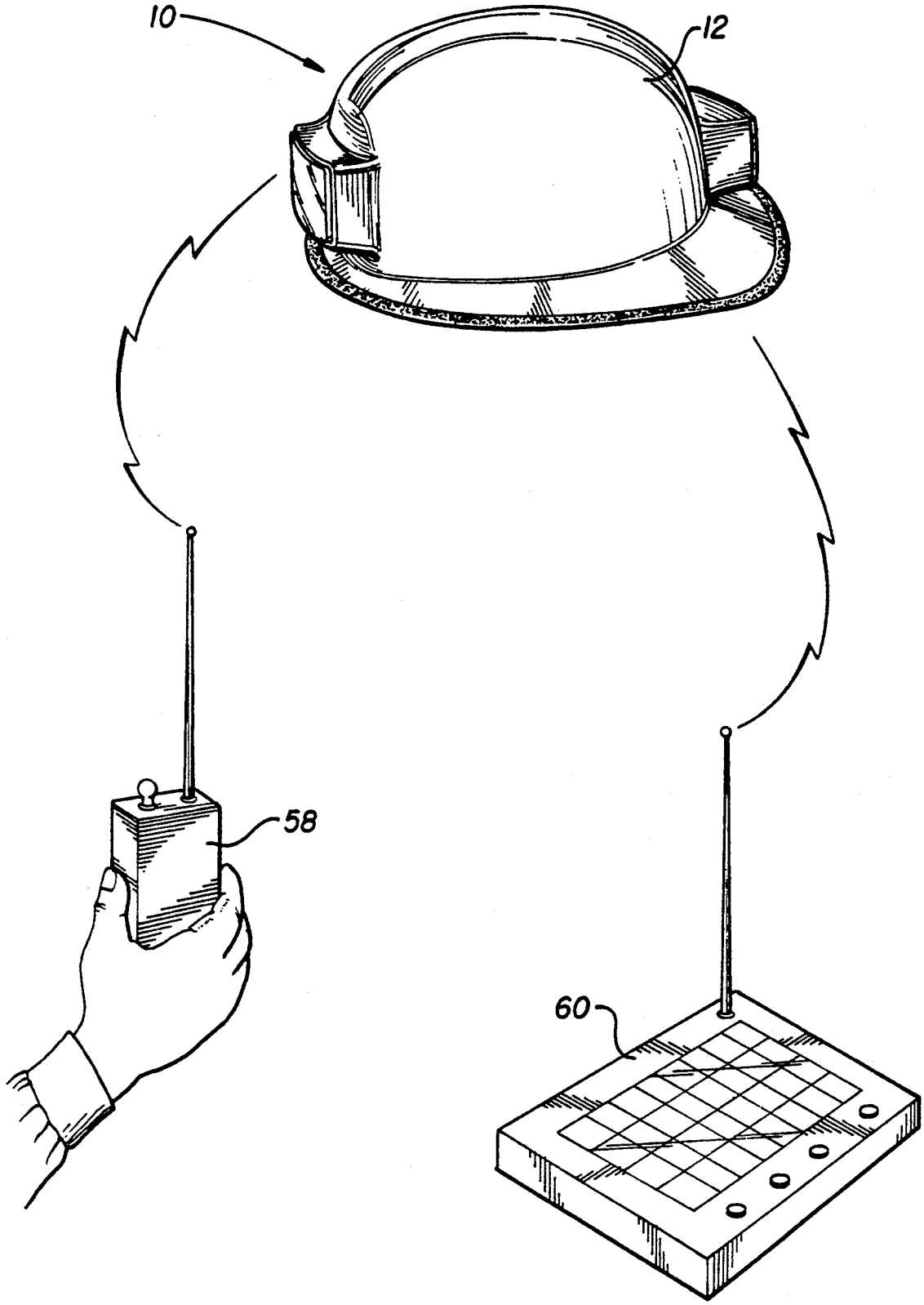
FIG. 9 is a schematic view illustrating the remote control system for the front and rear assemblies of the fireman's helmet.

As shown in FIG. 8, operatively connected to the battery is an alarm device 116 that indicates to the user that effective battery power has dropped below a predetermined safe level. The alarm emits an audible signal at least 15 minutes prior to the battery reaching a power level that would be inadequate for safety purposes.

Also, in addition, helmet 10 is provided with a clock 76 mounted behind lens 38. Clock 76 is preferably a digital readout clock and is interconnected within the electrical circuit of the front and rear light assemblies and would be actuated once the fireman has actuated either or both light assemblies in a flashing mode. If a fireman is rescued in an emergency situation, a medical team would know the approximate time that the fireman has been subjected to the problem. The clock 76 would also have a reset mechanism that would enable it to be automatically turned back to a time "0" situation.

Also, the helmet is provided with an antenna 74. The antenna 74 is embedded within the surrounding rim of helmet 10 and is part of the communications system previously described. The antenna is a small flexible wire.

Figure 7:
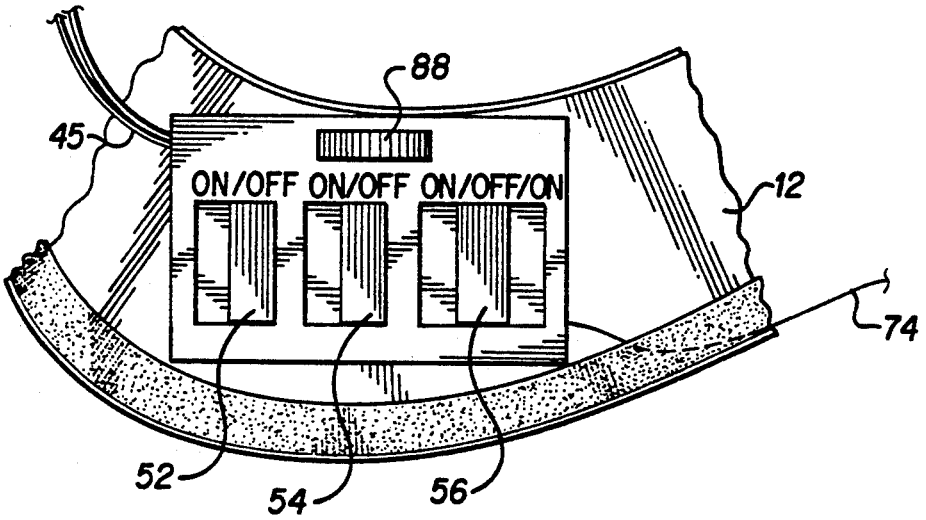
FIG. 7 is a fragmentary perspective view of the control block for the second embodiment.

FIG. 7 shows an alternate control panel 82 for controlling the front and rear light assemblies. The panel includes two switches 84 and 86. Each switch is designed to move through three positions. Switch 86 has positions 1, 2, and 3, and switch 84 has positions 4, 5, and 6. Extending from switch 86 are lines 100, 102 that connect with rear light 36 and front light 24, respectively. Extending from switch 84 are lines 104 and 106 and there is provided a cross connecting line 108 that extends between lines 104 and 106. Connected in line 104 is a time or stop watch type clock 76 and a flasher 110. In addition, connected in lines 104 and 106 is a pair of diodes 112 and 114. Completing the circuit is a conventional battery alarm 116 and a battery pack 118.

In operation, first assume that switch 84 is in the "off" or number 5 position. With switch 84 switched to the number 1 "on" position, then only rear light 36 would be activated and it would be activated continuously. By switching 86 to the number 3 "on" position, then the front lights 24 would be activated and would burn continuously.

Now switching 84 to the number 4 "on" position with switch 86 in the "off" or number 2 position would result in both front and rear lights 24 and 36 being flashed. At the same time, clock 76 would be activated and start counting time. With switch 84 in the number 4 "on" position and switch 86 in the number 1 position, rear light 36 would burn continuously while light 24 would flash. By switching 86 to the number 3 "on" position and maintaining switch 84 in the number 4 "on" position, front lights 24 would burn continuously while rear light 36 would flash.

Both embodiments of the fireman's helmet may be provided with an impact switch 49 fitted in a recess in the top underside of the helmet. The impact switch is electrically connected to the flasher on the helmet and would be activated in response to a certain amount of predetermined force or pressure on the helmet. At the same time, a remote signal is sent back to either the control device 58 or a central receiving station to indicate that a fireman may be unconscious. Also, communication between control device 58 and locator 62 allows a fireman to be located.

Additionally, the helmet includes an impact liner 47 made from foam impact material and secured to the helmet by Velcro fasteners.

From the foregoing specification and discussion, it can be appreciated that because all wires are placed in molded grooves and all other components fitted in recesses in the wall structure of the helmet, no structure extends outwardly in an obtrusive manner.

It is to be understood that the present invention is not limited to the embodiments described above, but encompasses any and all embodiments within the scope of the following claims.

I claim:

1. A helmet including an integral light assembly comprising: a helmet including a surrounding wall structure having an opening formed therein and defining a head receiving area within the helmet: a light assembly integrally mounted within the opening formed within the side wall structure; said light assembly including an outer lens disposed within a plane that lies closely adjacent the outer surface of the surrounding wall structure, a light bulb, and a light bulb holding frame extending inwardly from the opening within the side wall structure such that it projects into the space of the head receiving area; a battery pack disposed within the head receiving area of the helmet; switch means mounted to said helmet and operatively interconnected between the light bulb assembly and the battery pack for actuating the same; and including a clock integrally formed within the structure of the firemen's helmet whereby actuating the clock at a selected time enables one to determine an elapsed time from the time of actuation thereby enabling one to determine how long a fireman has been exposed to a dangerous situation; a flasher; a locator defined by said light assembly, said battery pack, flasher, switch means and clock being interconnected by wires which fit into grooves which are molded into the helmet; said switch means, said battery pack and said light assembly being fitted in recesses in the wall structure of said helmet; and an impact switch operatively connected to said flasher for providing an indication said helmet has been impacted.

2. The helmet of claim 1 including a receiver operatively connected to the light bulb; and means for remotely controlling and actuating a flasher and light bulb such that the helmet can be utilized as a signaling device in that the light bulb and flasher can be remotely actuated such that the light bulb emits a flashing signal.

3. The helmet of claim 1 wherein the surrounding wall structure includes an access opening panel formed in the exterior of the surrounding wall structure for enabling one to gain access to the battery pack.

4. The helmet of claim 1 wherein the wall structure of the helmet includes a surrounding brim structure and wherein an antenna is implanted within the surrounding brim structure of the helmet.

5. The helmet of claim 1 wherein the light assembly includes front and rear lights and wherein there is provided a control circuit for controlling the front and rear lights; and wherein said switch means comprises a pair of control switches, each switch being a three position switch and adapted to cooperate to control the front and rear lights such that they can be operated in a flashing or continuous mode.

6. The helmet of claim 5 wherein the control circuit includes a flasher and a clock and wherein the clock is placed in the control circuit such that it is automatically actuated in response to the flasher being actuated.

* * * * *